United States Patent [19]

Bommart

[11] 4,176,777

[45] Dec. 4, 1979

[54] SETTING ARRANGEMENT FOR ALIGNMENT AND GAP BETWEEN TWO RAIL ENDS

[75] Inventor: Patrick Bommart, Rueil-Malmaison, France

[73] Assignee: C. Delachaux, Gennevilliers, France

[21] Appl. No.: 922,347

[22] Filed: Jul. 6, 1978

[30] Foreign Application Priority Data

Jul. 8, 1977 [FR] France ..... 77 21157
Jun. 7, 1978 [FR] France ..... 78 17029

[51] Int. Cl.[2] ..... B23K 37/04

[52] U.S. Cl. ..... 228/5.1; 228/19; 228/49 R; 254/43

[58] Field of Search ..... 228/5.1, 6 R, 4.1, 19, 228/49 R; 254/43

[56] References Cited

U.S. PATENT DOCUMENTS

| | | | |
|---|---|---|---|
| 918,745 | 4/1909 | Goldschmidt et al. | 254/43 X |
| 925,630 | 6/1909 | Goldschmidt et al. | 254/43 X |
| 1,757,148 | 5/1930 | Spilsbury | 254/43 X |
| 1,878,809 | 9/1932 | Begtrup | 254/43 |
| 2,124,849 | 7/1938 | Drain, Jr. | 228/5.1 |
| 2,684,603 | 7/1954 | Schonberg | 228/6 R |

*Primary Examiner*—Francis S. Husar
*Assistant Examiner*—K. J. Ramsey
*Attorney, Agent, or Firm*—Parmelee, Miller, Welsh & Kratz

[57] ABSTRACT

Apparatus for aligning and setting the gap between two rail-ends prior to joining these two ends by fish plating or welding and possibly dressing the weld, comprises a rigid horizontal frame of open structure overlapping the two rails and providing an access area around the two ends to be joined. Two main presses and two end presses are mounted in line on the frame and arranged so that the two main presses are located between the end presses. Each combination of a main press and an end press serves to grip one of the two rails to be joined. The gap setting means can be locked on the two rails and has rams for moving the rails together or apart. Weld dressing means for eliminating the weld bead formed after a weld joining operation comprises a dressing tool movable by the aforesaid rams. The apparatus is especially for use in laying or reconditioning railway lines.

13 Claims, 12 Drawing Figures

XII
XII
130
132
134
136
138
138
140
140
142
142
144
144
146
148
148
150
152
156
158
160
164
164
165
165
166
168
170
170
172
172
174
174
176
178
180
180
182
182
184
186
188
190
192
194
196

SETTING ARRANGEMENT FOR ALIGNMENT AND GAP BETWEEN TWO RAIL ENDS

The present invention relates to apparatus for aligning and setting the gap between two rail ends prior to connecting the ends together by fish-plating or welding.

It relates more particularly to such apparatus having the aforementioned facility of allowing dressing of welding flush in the event of a welded connection of the two rail ends.

When connecting two rail ends, particularly railway rails, it is necessary firstly to correctly position the rails before connecting them. In addition when the connection is effected by welding, for instance aluminothermal welding, partial and, where possible, total dressing of the weld bead formed must be carried out after welding.

Rail setting consists in adjusting the gap between the rail ends to be connected, in aligning the adjacent vertical faces of the rails to be connected, and in slightly curving the rail ends upwards, which curvature is intended essentially to assist the weld connection.

Dressing consists in eliminating the weld bead at least from the top and the two sides of the railhead and where possible over the whole of the rail profile.

Hitherto, setting operations have usually been effected by means of a suitable set of wedges, while dressing is usually effected by hand or by a suitable machine.

Apparatus is known for maintaining the gap between rails to be connected, which apparatus consists of two presses connected together by means of tie-bars. However such apparatus does not allow the setting operations referred to above to be carried out.

Since practically all setting and dressing operations are carried out by hand, they are time-consuming, they do not always have the desired reliability and they require skilled labour.

It is an object of the present invention to obviate or mitigate these difficulties by providing apparatus allowing all these operations to be carried out more quickly, with greater reliability, and with a minimum of skilled labour.

The apparatus according to the invention comprises a frame overlapping the two rails and providing an access area around the two rail ends to be connected, two main presses and two end presses mounted in line on the frame and arranged so that the two main presses are located between the two end presses and each combination of a main press and an end press being adapted to secure one of the rails to be connected, means for locking onto the two rails to adjust the gap therebetween and comprising rams for moving the rails towards or away from one another, and dressing means adapted to eliminate any weld bead formed after a connecting operation involving welding and comprising a dressing tool movable by the gap adjustment rams.

Preferably, the frame comprises two components for overlapping the rails and secured together by two beams and each carrying a main press and an end press, and the gap setting means and the dressing means consisting of an assembly supported by the frame and movable between a rest position where it lies on the frame and a working position where it is located in the frame access area, the assembly comprising a frame having locking means for gripping one or other of the two rails to permit gap adjustment before the connecting operation, and a dressing tool for removing the weld bead after the connecting operation if the latter involved welding.

Alternatively, the frame comprises two components for overlapping the rails and secured together by beams and each mounting a main press and an end press, one of the components being movable along the beams by rams to ensure movement of the components together or apart and the movable component having a dressing tool. This arrangement has the advantage of allowing forging weld-operations, the two rail ends being brought together by the relative displacement of the two components whereof the respective presses are locked on the two rail ends.

Embodiments of the present invention will now be described, by way of example, with reference to the accompanying drawings, in which.

Figure 1:
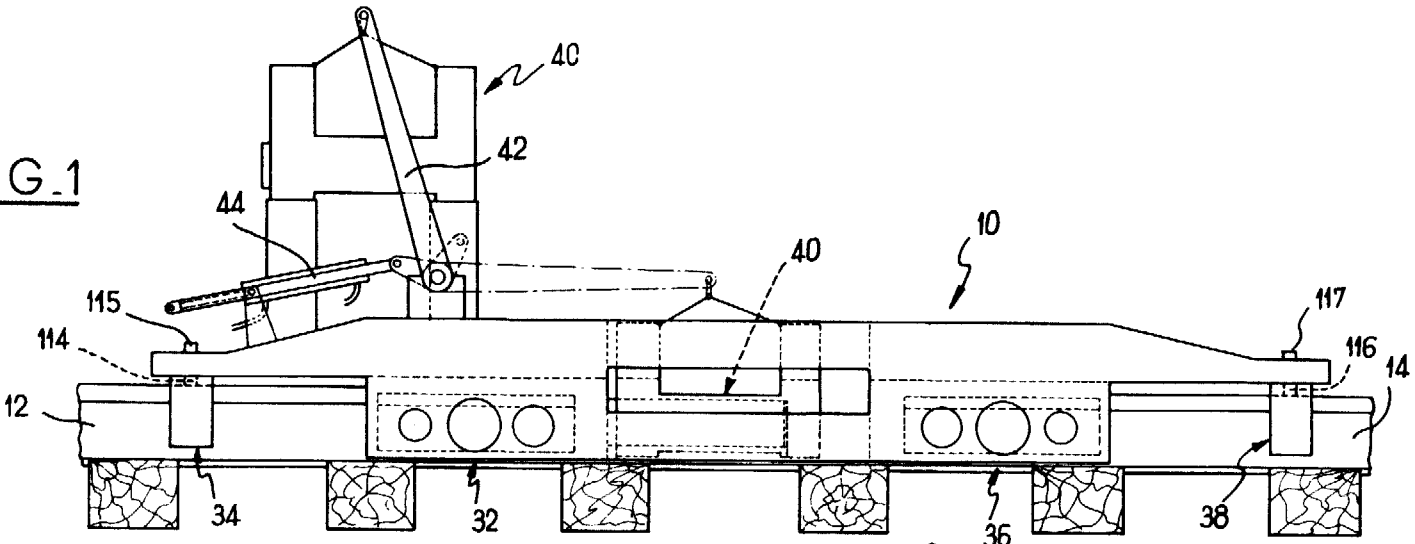
FIG. 1 is a front elevation of apparatus according to the invention in which the setting means is in the rest position.
Figure 2:
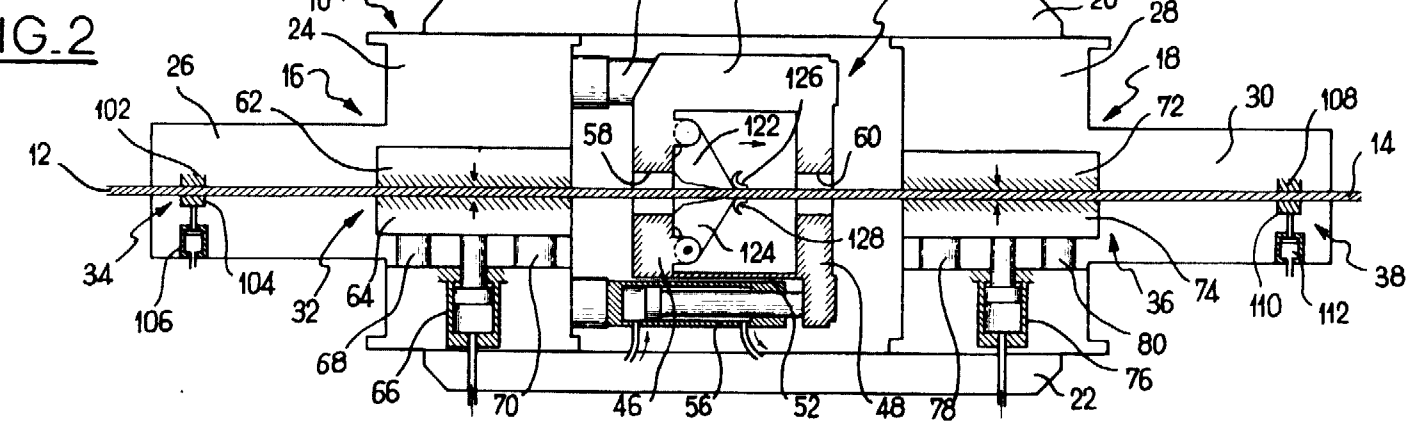
FIG. 2 is a plan view of the apparatus of FIG. 1, the setting means being in the working position for dressing purposes.
Figure 3:
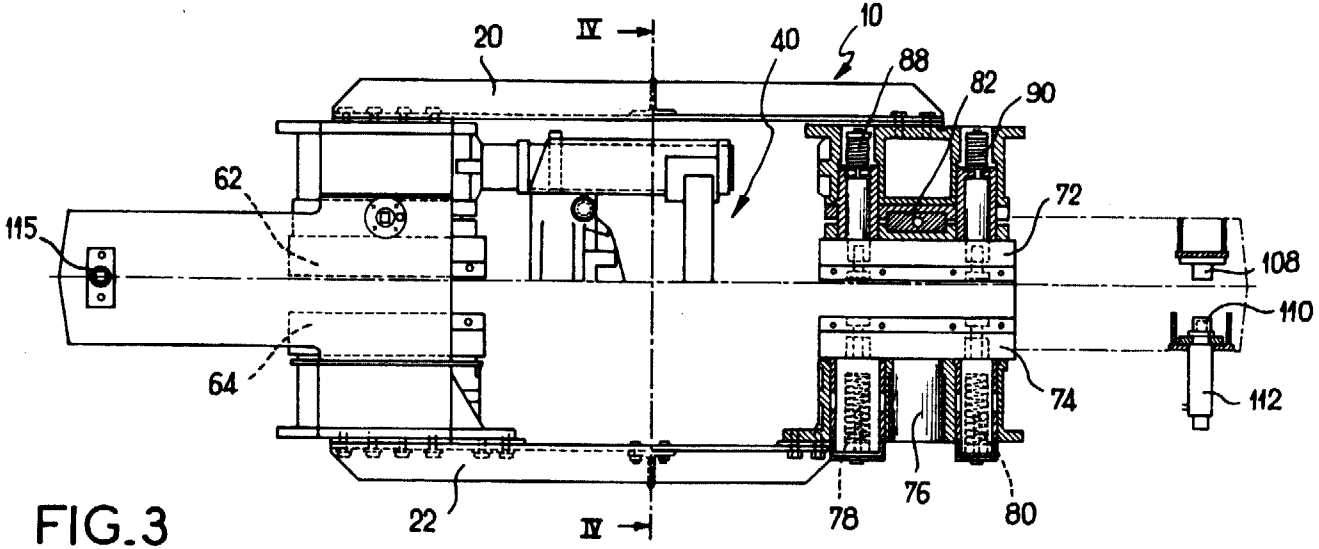
FIG. 3 is a detailed fragmentary view of FIG. 2.
Figure 4:
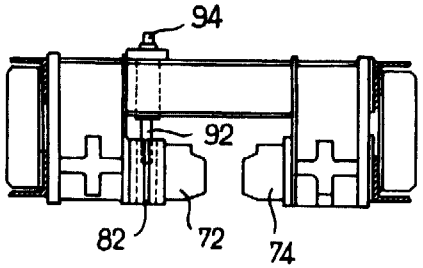
FIG. 4 is a section on the line IV—IV of FIG. 3.

Referring more particularly to FIGS. 1 and 2, the apparatus according to the invention is shown applied to a left-hand rail 12 and a right-hand rail 14 located on sleepers and for joining together at their ends. The apparatus comprises a rigid horizontal frame 10 defined by two rail overlapping components 16 and 18 secured together by means of longitudinal beams 20 and 22. The component 16 consists of an inverted U-member 24 overlapping the rail 12 and provided with an extension 26. Similarly, the component 18 consists of an inverted U-member 28 overlapping the rail 14 and provided with an extension 30.

The frame 10 is located so that its centre coincides with the junction of the ends of the rails to be connected. In this manner, the frame defines the two inverted U-members 24 and 28 and the beams 20 and 22 an access area around the ends of the two rails to be joined to allow setting and joining and, if a welded joint, eventual dressing.

A main press 32 is secured to the U-member 24 and an end press 34 secure to the extension 26. Similarly, a main press 36 is secured to the member 28 and an end press 38 secured to the extension 30, the presses 36 and 38 being in line with presses 32 and 34.

The two main presses 32 and 36 are located between the two end presses 34 and 38, the main press 32 and end press 34 serving to hold the left-hand rail 12, and the main press 36 and the end press 38 being provided to hold the right-hand rail 14.

It should be noted that the gap between each main press and its end press must be sufficient to allow correct alignment of the two rails when these are held by the main presses and end presses. When locking these presses, the main presses carry out two successive operations, i.e. firstly lifting the rail ends upwards and then holding the ends, while the end presses serve only to hold and position the rails.

The frame 10 is also provided with an adjustable assembly 40 for setting the gap and for dressing, the assembly being carried on two pivot arms 42 actuated by a double-acting cylinder 44 and movable between a rest position in which it lies on the frame 10 (see FIG. 1) and a working position where it is located in the frame access area (shown in dotted lines in FIG. 1 and in FIG. 2).

The assembly 40 consists of a frame defined by two transverse legs 46 and 48 interconnected by two beams 50 and 52. The assembly 40 can be moved inside the access area of the frame 10 by two double-acting rams 54 and 56 movable parallel with the rails, the cylinders bearing upon the member 24 of component 16 and the piston rod being connected to the leg 48 of the assembly 40, i.e. to the leg remote from member 24.

The legs 46 and 48 have respectively a tunnel 58 and a tunnel 60 allowing the passage of rail 12 and rail 14 respectively therethrough. As explained later, the tunnels 58 and 60 can receive locking wedges allowing the corresponding leg to be locked on one of the rails for a gap-setting operation, one of the two legs also mounting a dressing tool for removing the weld bead resulting from a welded joining operation. The main press 32 consists of a fixed jaw 62 bearing against one side of the web of the rail 12 and a jaw 64 movable horizontally and perpendicularly to the web of the rail 12 and bearing against the other side of the web of rail 12, the jaws 64 operated by a single-acting cylinder 66 and two return-springs 68 and 70.

Similarly, the main press 36 has a fixed jaw 72 for bearing against one side of the web of the rail 14 and a jaw 74 movable horizontally and perpendicularly to bear against the other side of web of rail 14, the jaw 74 being operated by a single-acting cylinder 76 and two return-springs 78 and 80.

Figure 8:
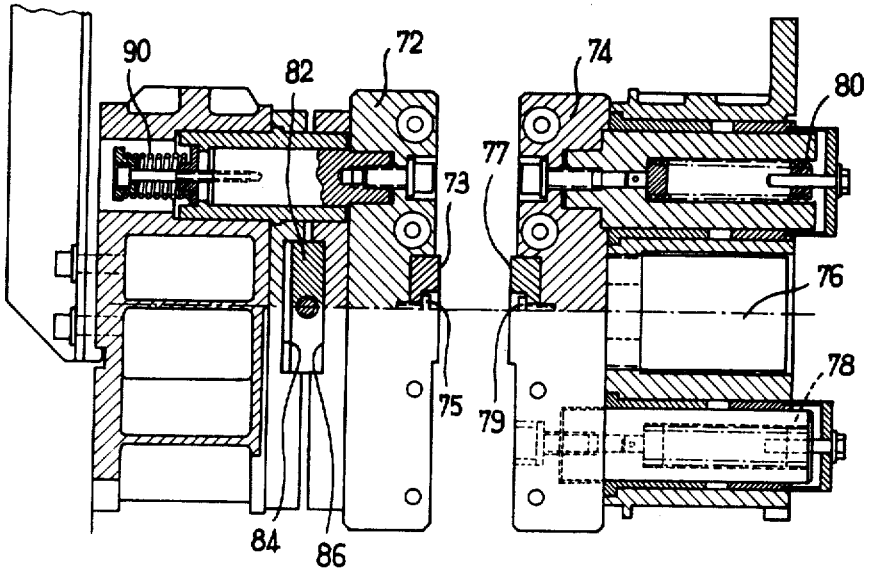
FIG. 8 is a plan view of the main press shown in FIG. 7.

The fixed and movable jaws of the main presses are each fitted with a removable adaptor to suit the rail profile. Thus, the jaws 72 and 74 of the main press 36 are fitted respectively with an adaptor 73 secured by a stud 75 and an adaptor 77 secured by a stud 79 (see FIG. 8).

The fixed jaws 62 and 72 of the main presses are each fitted with means for positioning the rails as explained below with particular reference to FIGS. 3, 4, 7 and 8.

Thus, the fixed jaw 72 of the main press 36 is adjustable in relation to the frame 10 by means of a slightly tapered wedge 82 moving vertically between a vertical wall 84 of the frame 10 and a sloping wall 86 of the fixed jaw 72, the two walls being urged towards each other by means of springs 88 and 90. The wedge 82 can be moved vertically by a control rod 92 having a threaded lower end engaging an internal thread in wedge 82 and having a head 94 (see FIG. 4) at its upper end allowing rotating of the rod by means of a suitable spanner. When the wedge 82 is raised, the fixed jaw 72 is urged closer to the rail 14 and conversely, when the wedge 82 is lowered, the fixed jaw 72 moves away from rail 14.

The fixed jaws 62 and 72 and the movable jaws 64 and 74 of the main presses 32 and 36 are each fitted with means which, during closure of the fixed jaws and movable jaws, allow, in addition to the gripping of the rail, curving of the rail to ensure a slight raising of the rail as required for subsequent joining by welding. As an example, the jaw 74 is fitted with a set of bearings 96 acting in cooperation with the underside of the head of rail 14 to ensure slight curvature of the rail 14 upwards on closure of the movable jaw 74 and the fixed jaw 72 by the cylinder 76 (see FIG. 7).

The ball bearing 96, is enclosed but not locked inside a head 97 into which is screwed a taper bowl 98 integral with a rod 99 on which is threaded a set of spring washers 100 and an externally threaded member 101. The washers 100 are initially held under tension by means of a nut 103 and washer 105, both inserted inside the member 101, the nut 103 screw-engaging the lower end of the rod 99 threaded for that purpose. The assembly thus formed is a ball bearing carrier unit in which the ball is resiliently mounted and held under tension adjustable by means of a nut 103. The ball carrier unit thus formed is located in a recess in jaw 74 and is vertically adjusted in relation to the jaw by member 101, the external thread of which cooperates with an internal thread in the jaw recess. Each jaw on the main presses is thus fitted with several ball-carrier units, for instance four units per jaw, adjusted vertically in accordance with the curvature to be given to the rail. The ball carrier units on a same jaw are vertically adjusted in a stepped manner so that the unit closest to the rail end is the highest and that furthest from the rail end is the lowest, the balls thus representing a sloping straight line.

The end press 34 has a fixed jaw 102 and a jaw 104 movable horizontally and perpendicularly to rail 12 by a double-acting cylinder 106. Similarly, the end press 38 has a fixed jaw 108 and a jaw 110 movable horizontally and perpendicularly to the web of rail 14 by a double-acting cylinder 12.

The frame 10 is also fitted with two vertically adjustable bearing points 114 and 116 operating respectively on the top of the rail 12 and the top of the rail 14 in the region of the end presses 34 and 38. The bearing points 114 and 116 have respectively heads 115 and 117 and are adjustable by a suitable spanner (see FIGS. 1 and 3). On locking the main presses and the end presses, these bearing points bear upon the top of the rails thus acting in conjunction with the balls 96 of the main presses to ensure a slight lifting of the rail ends.

The apparatus according to the invention is used in the manner described below in detail.

The frame is placed horizontally and in an overlapping manner over the two rails 12 and 14 located end to end, and from which the fasteners to the sleepers closest to the two ends to be joined have been removed. The frame is centred approximately at the joint of the two rail ends.

Once the frame has been correctly located on the two rails to be joined, the setting of the rails is effected. For this purpose the end presses 34 and 38 are locked by actuating their respective cylinders 106 and 112. The main presses 32 and 36 are then locked by means of their respective cylinders 66 and 76. The lateral alignment of the rails is first checked then, if necessary, one of the fixed jaws 62 and 72 is adjusted by wedge 82, for instance in the case where two rails to be welded together are not of exactly the same profile or where one of the two rails presents certain relief irregularities, such as identification lettering or references formed in the web of the rail. If the gap between the rail ends to be welded is not suitable, adjustment of the gap is effected.

For that purpose, the assembly 40 is lowered by ram 44 to its working position.

Figure 5:
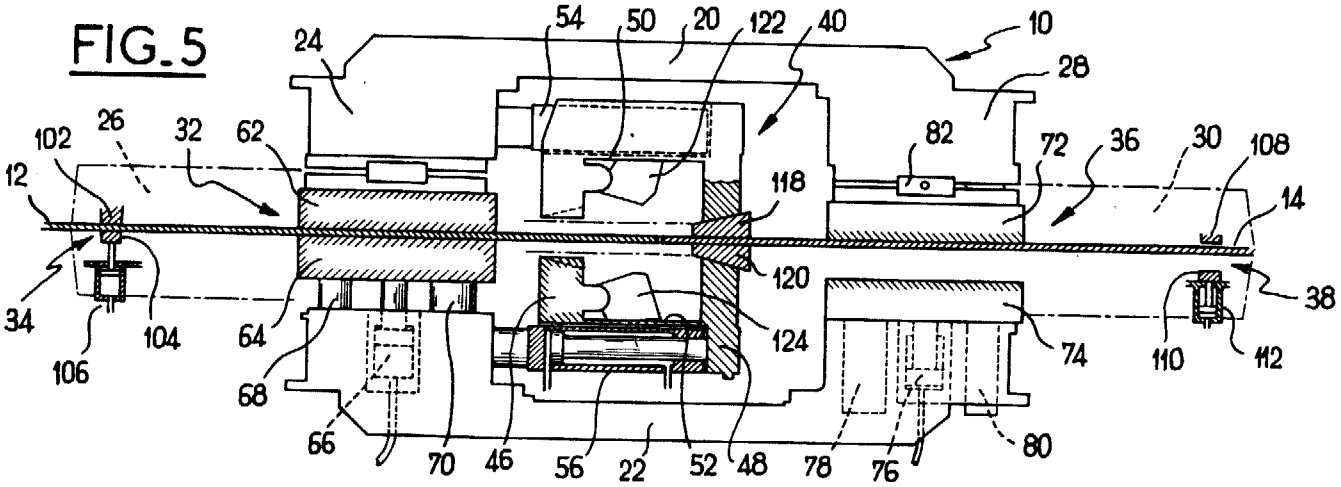
FIG. 5 is a view similar to FIG. 2 with the setting means in the working position for increasing the gap.
Figure 6:
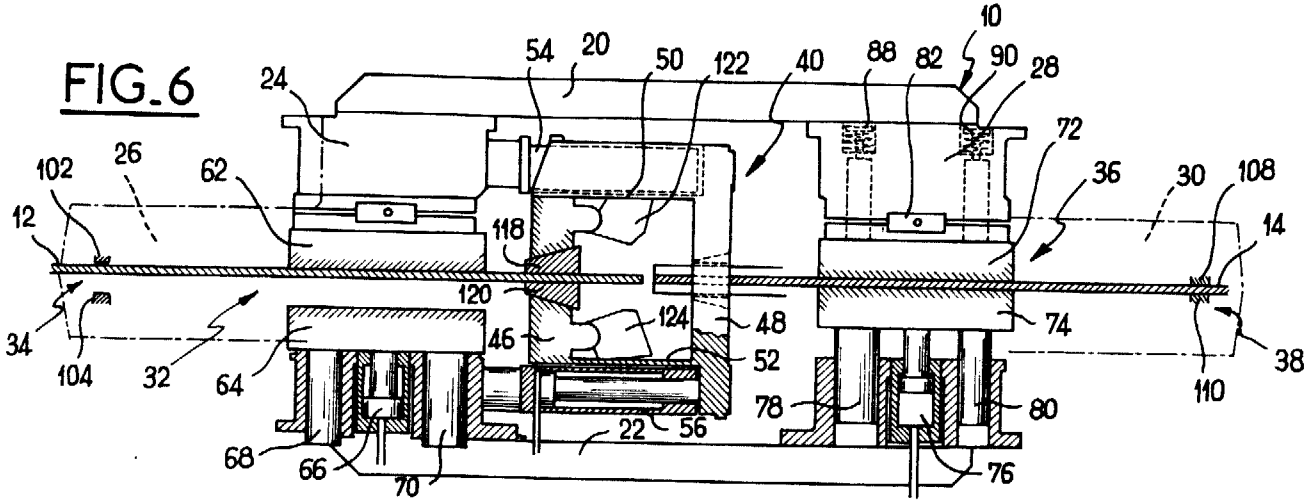
FIG. 6 is a view similar to FIG. 5 in which the setting means is in the working position for closing the gap.
Figure 7:
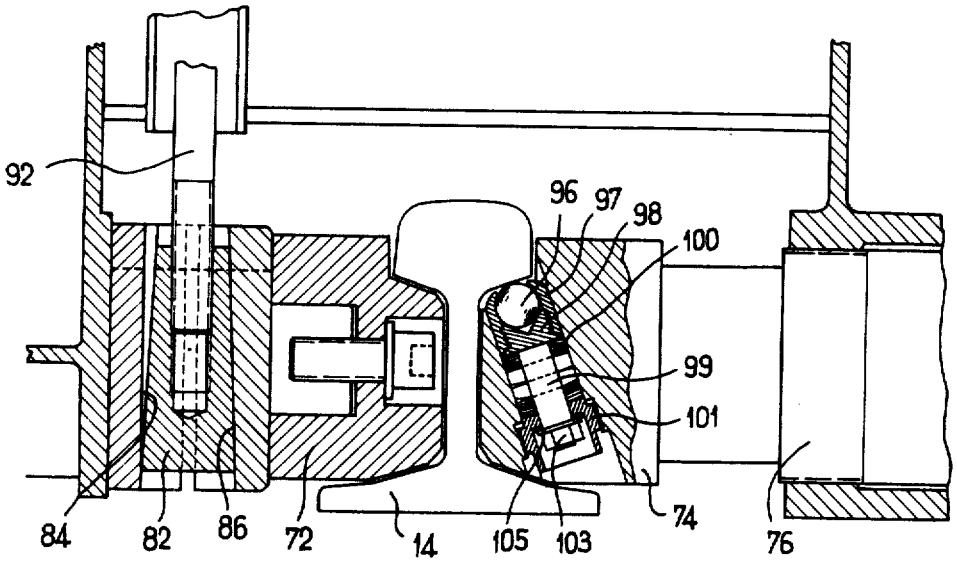
FIG. 7 is a detailed section of one of the main presses.

The procedure now described with particular reference to FIGS. 5 and 6 is then adopted, depending on whether the gap between the ends of the two rails is to be increased or reduced.

In the case of an increase in the gap (see FIG. 5) the main press 36 and the end press 38 locking the right hand rail 14 are released, the lefthand rail 12 remaining locked in the main press 32 and the end press 34.

The leg 48 of the assembly 40 is then locked on the right-hand rail 14 by means of wedges 118 and 120 and the rams 54 and 56 are actuated in such a manner that the frame formed by the two legs 46 and 48 and by the two beams 50 and 52 move from left to right (as shown in FIG. 5). This movement of the frame and consequently of the leg 48 results in the right hand rail 14 moving away from the left hand rail 12 which remains fixed, and consequently an increase in the gap. It then suffices to lock presses 36 and 38 on the rail 14 once again, to collapse rams 54 and 56 and to move assembly 40 back to its rest position by means of ram 44.

Where the gap is to be reduced, the main press 32 and the end press 34 gripping the left hand rail 12 are released, the right hand rail 14 remaining gripped by main press 36 and end press 38. The leg 46 of assembly 40 is then locked on the left hand rail 12 by means of wedges 118 and 120 and the rams 54 and 56 are actuated to move the frame and consequently the leg 46 from left to right (direction of FIG. 6). The movement ensures the closing up of the left hand rail 12 towards rail 14, which remains stationary, and consequently a reduction in the gap is achieved. The presses 32 and 34 are then simply locked once more on rail 12, the rams 54 and 56 collapsed, and the assembly moved to the rest position by means of ram cylinder 44.

The two rails 12 and 14 being thus adjusted and locked by presses 32, 34, 36 and 38, the rail ends are then joined by conventional means, using welding or fish plating.

In the case of welding, the operation may be effected for instance by the alumino-thermal method using a suitable/crucible and mould.

When the joint is welded and the welding operation is completed, presses 32, 34, 36 and 38 still remaining locked, the dressing operation is carried out. The assembly 40 is moved to its working position.

A dressing tool (see FIG. 2) consisting of two dressing blades 122 and 124 mounted so as to pivot on the leg 46 and movable between a working position (FIG. 2) and an inoperative position (FIG. 6) are disposed in working position.

The rams 54 and 56 are actuated to move the blades 122 and 124 and remove weld beads 126 and 128 (FIG. 2).

The assembly 40 is then moved back to its rest position and presses 32, 34, 36 and 38 are then released.

The apparatus can then be moved to a location where a further joint is required.

Figures 9, 10:
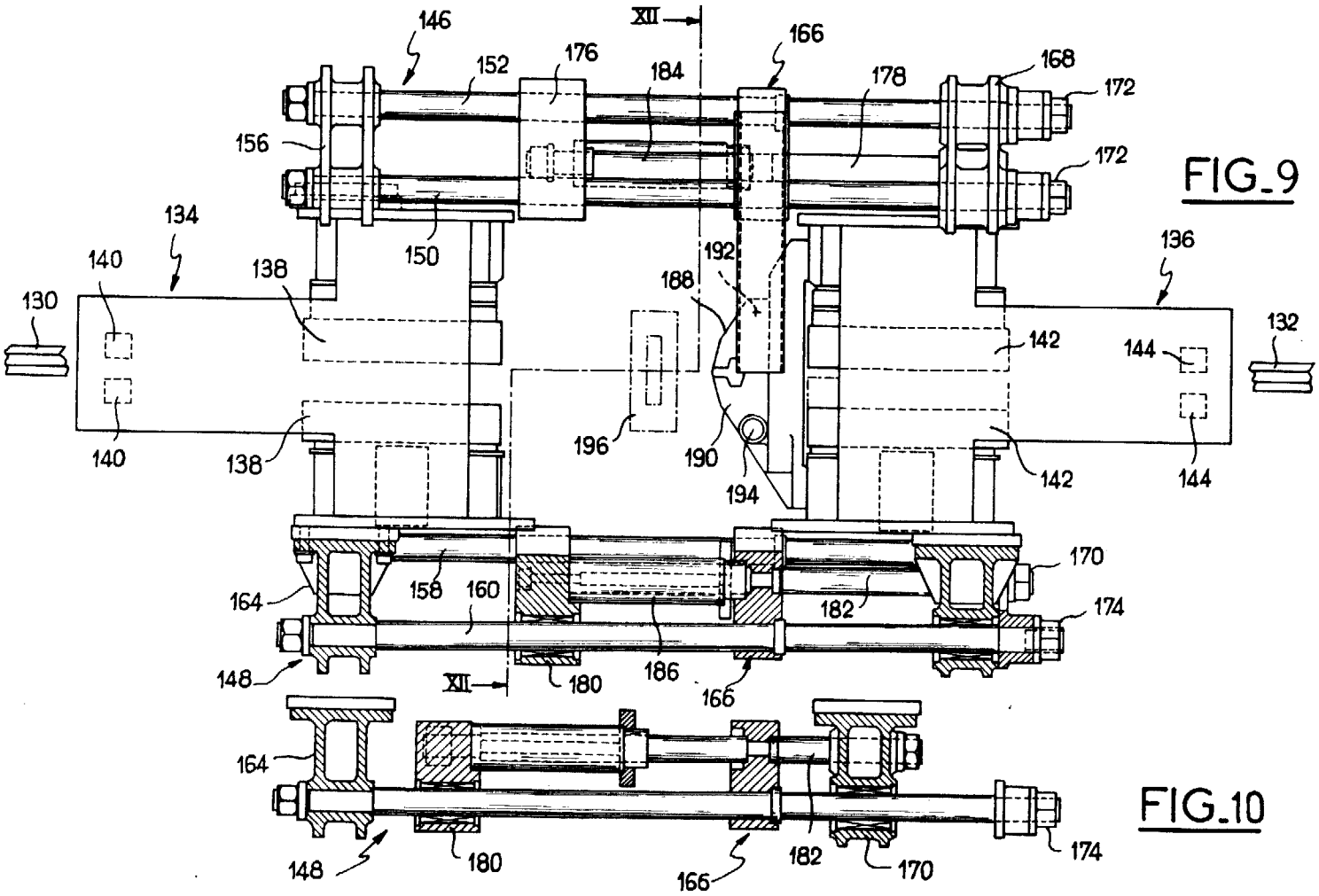
FIG. 9 is a part-sectional plan view of an alternative apparatus according to the invention, with the rail overlapping components spaced apart.
FIG. 10 is a fragmentary view of FIG. 9 in which the components are adjacent one another.
Figure 12:
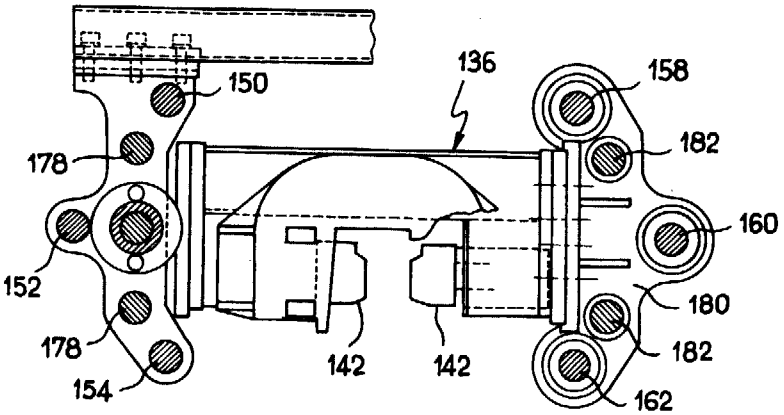
FIG. 12 is a section on the line XII—XII of FIG. 9.

FIG. 9 shows an alternative apparatus according to the invention applying a left hand rail 130 and a right hand rail 132 to be joined at the ends. For convenience, the rails 130 and 132 are shown in part only, in the area outside the apparatus. The apparatus comprises a rigid horizontal frame defined by two rail overlapping components 134 and 136 similar to components 16 and 18. Component 134 comprises a main press 138 and an end press 140 and component 136 comprises a main press 142 and an end press 144. The component 134 is integral with two side beams 146 and 148 secured respectively to either end of component 134. The beam 146 consists of three parallel bars 150, 152, 154 rigidly secured to a bracket 156 secured to the component 134. Similarly, the beam 148 consists of three parallel bars 158, 160 and 162 secured to a bracket 164 secured to the component 134. Bars 150, 152, and 154 of the beam 146 and bars 158, 160 and 162 of beam 148 are arranged in a triangle configuration (see FIG. 12).

The three bars of beam 146 are grouped together and secured to the three bars of beam 148 by means of a traverse 166 rigidly fixed to the two beams. The component 136 is movable along the beams 146 and 148 and for that purpose has two housings 168 and 170 slidable along the three rods of beam 146 and the three rods of beam 148 respectively. The displacement stroke of the two housings 168 and 170 is limited, on the one hand, by the traverse 166 and, on the other hand, by stops such as 172 and 174 fixed at the ends of the two beams. Housing 168 is rigidly secured to a slide 176 movable along the beam 146 through the intermediary of two bars 178. Similarly the housing 170 is connected to a slide 180 movable along the beam 148 through the intermediary of bars 182.

Figure 11:
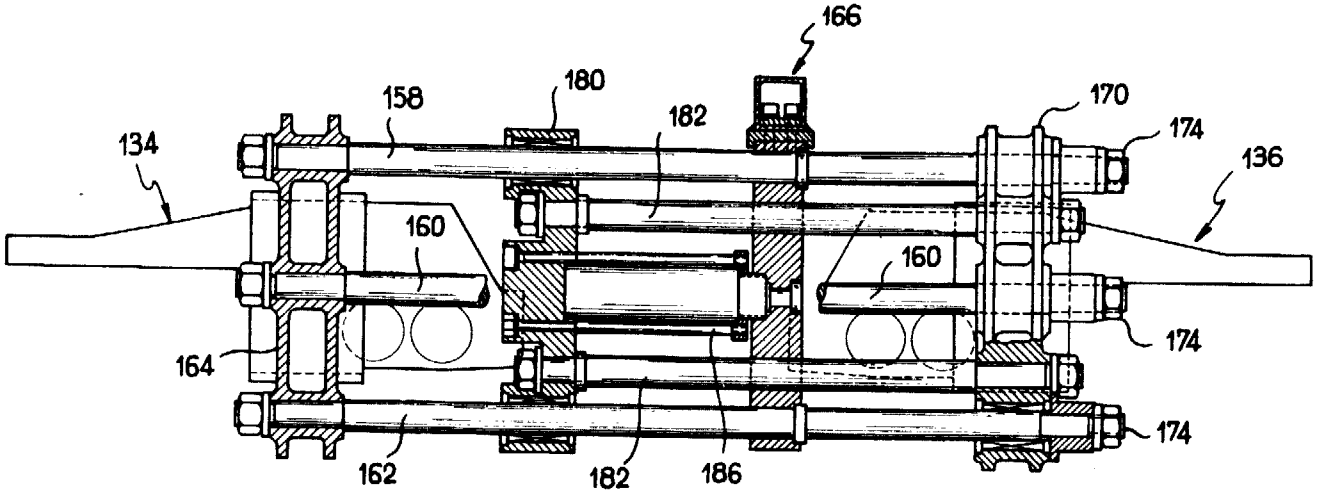
FIG. 11 is a side view of FIG. 9.

The slide 176 supports the cylinder of a jack or ram 184 whereof the rod is connected to the traverse 166 and the slide 180 supports the body of a jack or ram 186 whereof the rod is connected to the traverse 166. Given that the traverse is disposed between housing 168 and slide 176 on the one hand and between housing 170 and the slide 180 on the other hand, the extension or retraction of the rods of jacks or rams 184 and 186 respectively cause the two components to move together or apart. Thus, when the rods are retracted, the two components 134 and 136 are in their most spaced apart position, as shown in FIG. 9 and FIG. 11. On the other hand, when the rods are in the extended position, the components 134 and 136 are in their closest position shown in FIG. 10. The component 136 has an adjustable dressing assembly consisting of two blades 188 and 190 mounted so as to pivot about two vertical axes 192 and 194.

In use, the frame is disposed horizontally so as to overlap the two rails 130 and 132 and the rails are then adjusted, in the same way as described with reference to FIGS. 1 to 8. After completing the adjustment, the gap between the two ends of rails 130 and 132 is adjusted. For this purpose, the two presses of the component 134 are locked on rail 130 and the two presses of component 136 are locked on rail 132. The cylinders 184 and 186 are then actuated to move the two components 134 and 136 closer together or apart. After completing the gap adjustment the welding operation is carried out. For this purpose, the rails are maintained in position by the locking of the presses of the two components 134 and 136, the joint is completed by fish-plating or welding. In the case of welding, this is effected preferably by alumino-thermal welding using a mould 196 (see FIG. 9) around the two ends to be welded. The joint can be advantageously completed by forging, bringing together the two ends of the rails by actuating the rams 184 and 186 after completing the casting of the molten metal.

When the rails are joined by welding, the weld bead is removed by means of the two blades 188 and 190. For this purpose, the two blades 188 and 190 are brought into the position shown in FIG. 9, and the component 134 is locked onto rail 130 and while the component 136 is released from rail 132, the component 136 is then moved towards the component 134 by actuating the rams 182 and 184. During the movement of the component 136 the blades 188 and 190 contact the weld bead and progressively remove it.

The different rams of apparatus according to the invention are hydraulically operated.

Since, during the dressing operation, the rams actuating the dressing tool require a large output of oil over a relatively short period, a pressurised oil accumulator can be usefully used, and be re-charged during non-operational periods.

Furthermore the apparatus according to the invention may be fitted with other accessories such as a crucible support, a mould support, a mould positioning and locking arrangement to suit the particular application of the alumino-thermal welding process.

Apparatus according to the invention consequently allows all operations associated with the joining of rails to be carried out, i.e. the adjustment of rails, the joining of rails, either by fish-plating or by welding, and the dressing of the weld when the joint is effected by welding. The rigid structure of the frame prevents any distortion of the rails due to the forces exerted by the various rams and the welding or fish-plating of the rails.

It should be noted that the spacing between the two main presses must be fairly large, for instance of the order of 1 m, in order to allow a sufficient area of access to permit welding or fish plating, or replacement of a fish plate by a weld.

In view of the particular structure of movable jaws and fixed jaws on the main presses, resulting from the presence of the balls and the adaptors, these jaws allow successful raising and clamping of the ends of a considerable number of differing rail profiles using the same jaw, thus avoiding the need for a different type of jaw for each type of rail profile.

The assembly allowing adjustment of the gap between the ends to be joined and the eventual dressing of the weld, has a compact structure compatible with the dimensions of the access area of the frame and as a result of the presence of the two legs, ensures better guiding of the dressing blades. Furthermore the locking of the two rails during the dressing operation eliminates any risk of release of metal in the welded zone.

It will be noted that the end presses may be low capacity presses should they be intended exclusively for lightly holding the rail or high capacity presses where these are intended to ensure forcible gripping of the rails.

Where the apparatus according to the invention is used for joining fish plating, in which the curving of the rails is not necessary, the curving effect exerted by the lifting balls may be neutralised by raising the bearing points of the end presses. However, in the majority of cases such a modification of the adjustment to these bearings points is not necessary in view of the limited degree of lift normally exerted by the balls and the possible clearance of the fish plate bolts through the rails.

It should be noted that the sloping form on the underside of the rail head, also described as the fish plate upper bearing face, facilitates the action of the lifting balls for the purpose of curving the rail, which is effected progressively on bringing together the jaws of the main presses.

It will also be noted that the narrow transverse dimension of the frame allows the use of two apparatus in parallel to effect two simultaneous joints on the same track, even in the case of small gauge track, such as 1 m gauge tracks.

The apparatus may be transported to the welding site by means of a suitable carriage.

The apparatus according to the invention is consequently suitable for the laying and reconditioning of railways, regardless of the type of rail to be welded or fish plated.

I claim:

1. Apparatus for aligning and setting the gap between two rail ends prior to joining the two ends by fish plating or welding and eventual dressing of the weld, the apparatus comprising a rigid frame for overlapping the two rails and providing an access area around the two ends, two main presses and two end presses mounted in line on the frame and arranged so that the two main presses are located between the two end presses and each combination of a main press and an end press being adapted to grip one of the two rails to be joined, gap setting means adapted to be secured on to the two rails and having rams for moving the rails together or apart and dressing means for removing the weld bead formed after a welding joining operation and comprising a movable dressing tool displaceable by the gap setting means rams.

2. Apparatus according to claim 1, in which each main press has a fixed jaw bar bearing against one side of the rail web and one movable jaw movable horizontally and perpendicularly to the rail web for contact with the other side of the rail web, the movable jaw being operated by a ram and a return spring.

3. Apparatus according to claim 2, in which the fixed jaw is adjustable relative to the frame by a wedge moved vertically between a vertical wall of the frame and a sloping wall of the fixed jaw, the two walls being spring urged towards each other.

4. Apparatus according to claim 2, in which the fixed jaw and the movable jaw of each of the main presses mounts vertically adjustable ball carrier units in which a ball is mounted so as to bear resiliently against the underside of the head of the rail so as to induce slight upward curvature of the rail on closing the jaws on the rail.

5. Apparatus according to claim 2, in which the fixed jaw and the movable jaw of each of the main presses each comprises a removable adaptor, whereby the jaws can be used on any of a large number of different rail profiles.

6. Apparatus according to claim 1, in which each end press comprises a fixed jaw to bear against one side of the web of the rail and a movable jaw movable horizontally and perpendicularly against the other side of the web of the rail by a double-acting cylinder.

7. Apparatus according to claim 1, in which the frame is provided with two vertically adjustable bearing points acting on top of the two rails in the region of the end presses.

8. Apparatus according to claim 1, in which the frame comprises two rail-overlapping components secured together by two beams and each supporting a main press and an end press, and in which the gap setting means and the dressing means comprise of an adjustable assembly supported by the frame and movable between a rest position where it lies on the frame and a working position where it is located in the frame access area, the assembly comprising a frame adjustable within the access area parallel to the rails, the assembly frame comprising locking means for rendering the frame fast with one or other of the two rails to permit a gap adjustment before the joining operation and having a dressing tool for removing the weld-bead after the weld joining operation.

9. Apparatus according to claim 8, in which the assembly frame has two legs actuated by two rams bearing against the apparatus frame, each leg having a tunnel for passage of a rail and adapted to receive locking wedges to secure the leg on its corresponding rail, one of the two legs also mounting the dressing tool.

10. Apparatus according to claim 9, in which the cylinder for each ram bears upon the apparatus frame and the rod for each ram is secured to the leg remote from the bearing point of the cylinders upon the apparatus frame.

11. Apparatus according to claim 1, in which the frame has two rail overlapping components secured to each other by two beams and each supporting a main press and an end press, one of the components being movable along the beams by means of rams to bring the two components together or apart and the movable component having a dressing tool.

12. Apparatus according to claim 1, in which the movable component slides on each beam by means of a housing rigidly connected to a slide movable along the beam, this slide supporting the cylinder of a ram which has its rod connected to a traverse rigidly secured to the beam, the traverse being located between the housing and the slide so that the extension or contraction of the rod ensures movement of the two components together or apart respectively.

13. Apparatus according to claim 12, in which each beam consists of three parallel bars each having an end rigidly fixed to the non-movable component and an end with a stop limiting movement of the movable component.

* * * * *